United States Patent [19]

Taylor

[11] Patent Number: 4,801,128

[45] Date of Patent: Jan. 31, 1989

[54] GROUND IMBEDDED SUPPORT SYSTEM

[76] Inventor: Lawrence Taylor, P.O. Box 210.577, Dutch Fork PO Branch, Columbia, S.C. 29221

[21] Appl. No.: 22,862

[22] Filed: Mar. 6, 1987

[51] Int. Cl.[4] ..... E04H 17/14

[52] U.S. Cl. ..... 256/68; 175/19; 73/84; 52/154

[58] Field of Search ..... 52/153, 156, 157, 165, 52/155, 154, 297, 298; 256/68, 19, 35; 175/19; 73/84, 82, 85

[56] References Cited

U.S. PATENT DOCUMENTS

| | | | |
|---|---|---|---|
| 180,379 | 7/1876 | Sherman | 256/68 |
| 261,854 | 8/1882 | Kingsbury et al. . | |
| 272,149 | 2/1883 | Newton | 52/298 |
| 486,973 | 11/1892 | Knox | 52/154 |
| 538,382 | 4/1895 | Petree | 175/19 X |
| 701,992 | 6/1902 | Bowen | 175/19 |
| 994,742 | 6/1911 | Gregory | 256/35 X |
| 1,563,024 | 2/1924 | Grimaud . | |
| 1,658,118 | 2/1928 | Doddridge | 256/68 |
| 1,676,679 | 8/1923 | Bensinger . | |
| 3,444,659 | 5/1969 | Shanni | 52/155 X |
| 4,185,424 | 1/1980 | Streit | 52/155 X |

*Primary Examiner*—Andrew V. Kundrat

*Attorney, Agent, or Firm*—Kerkam, Stowell, Kondracki & Clarke

[57] ABSTRACT

A ground implanted support system includes a plurality of conical base members having irregular configurations in transverse cross section which are inserted in preformed complementary holes formed by a tool which is uniformly forced into the ground either manually or by controllable force producing means and thereafter each of the implanted base members receives a bolt, a plug, a post, or the like in a precast opening in the top of each base member. In a preferred form of the invention, the base members are precast from concrete and the base members are not inserted completely in the ground which reduces corrosion of the part being supported by the base members.

2 Claims, 3 Drawing Sheets

GROUND IMBEDDED SUPPORT SYSTEM

FIELD OF THE INVENTION

This invention relates to a system for providing ground support for fences, barriers, headers for building structures, and the like. While the invention has many fields of use, the application will be primarily directed to a building foundation and fencing system and parts thereof.

BACKGROUND OF THE INVENTION

In fencing and construction work, it is often desirable to put posts directly into the ground but infeasible because metal posts are corroded or rusted, depending upon choice of metal and ground chemistry or the wood used fails because of the type of wood eating soil life found in different areas. These posts are all driven to the same depth to have a uniform fence height, but the stability, especially for cattle fences, is not uniform.

The customary answer to such problems is to dig a post hole and then fill this with cement into which the fence or construction post is inserted to give a lasting foundation. This is a practical, but time consuming and expensive system, as it takes two separate trips to put in fencing, as even fast drying cement takes some time to harden, which means, for example, that two trips over each fence route are required, if prefabricated post bases are not used, and a ready supply of fresh mixed cement must be continually available.

The above problems are compounded by the problems encountered in fence soil formation and attachment to fence posts.

Over the years, inventors have conceived fencing constructions which overcame some of these problems, but not all of them. The following U.S. patents disclose some of these conceived constructions:

Fence Post Patents

U.S. Pat. No: 880,992, HAYES
U.S. Pat. No: 864,218, WOODRUFF
U.S. Pat. No: 1,419,108, BITTING
U.S. Pat. No: 261,854, KINGSBURY et al
U.S. Pat. No: 1,563,024, GRIMAUD
U.S. Pat. No: 1,676,679, BENSINGER

Post Supports and Hole Forming Implements

U.S. Pat. No: 4,588,157, MILLS
U.S. Pat. No: 4,271,646, MILLS
U.S. Pat. No: 12,385, BRULEY
U.S. Pat. No: 844,726, HUNTER
U.S. Pat. No: 973,887, STEINMETZ

Rail and Wire Attaching Devices

U.S. Pat. No: 709,695, BLAKE
U.S. Pat. No: 1,793,106, LINDEMUTH
U.S. Pat. No: 57,073, BETTIS, et al
U.S. Pat. No: 179,733, SHAVER
U.S. Pat. No: 2,998,109, JAHN
U.S. Pat. No: 206,131, FORD
U.S. Pat. No: 202,735, OLIVER, et al
U.S. Pat. No: 2,809,017, WONG

In the present invention, application and construction differ in many ways from the prior art which is either a stake which is pounded in the ground and may require a cap band to keep the concrete post from splitting because of the impact between the driving means and the concrete base, or which screws into the ground, requiring a special, powerful, and expensive machine that is difficult to transport, or is shovel buried in a dug hole. None of which methods provide a uniform result.

None of these prior systems make provisons for using different size bases, both in depth and girth to accommodate the different soil conditions which are commonly experienced along the length of a fence being installed. It is well known that the depth of the over burden varies considerably in many areas depending on the geological structure of the surface soil which may be sandy, loam, rocky, clay base, or soft and muddy.

Obviously the same concrete base will not be the most suitable for every sharply varying soil condition and the time, which is cost in today's world, varies greatly from post hole to post hole because a gravel bank in clay is as difficult to dig into as it is easy to dig in soft loam. Mud and marl are the worst, being sticky like taffy where each shovelful must be pushed off the shovel usually by foot before the next shovelful can be won.

The present construction permits the use of a wide variety of base types for different soil conditions because the implantation means for the bases are entirely novel in that they are entirely automated, and automatic in determining the type of base best suited for each post hole. The holes for the post are made first by another tool, probably, but not necessarily pneumatic, that drives a high quality pointed tool with a sufficiently hardened point (replacable of course) that can split most rocks that it might encounter in the soil. If unusual rocks are encountered very close to the surface where lateral post support may be insufficient, then a rock drill head can be used by the same pneumatic driver to make sufficient penetration to give adequate lateral support to the fence posts to be installed.

In respect to the present invention, each of the base units is driven to the same level of resistance, by means of a pneumatic or gasoline driven driver which is used to drive the hole maker prong and may be set for a given number of seconds of operation. Then, different posts being driven, even close together, may encounter various levels of soil from the permability of mud to gravel, and the hole maker will, therefore, be driven to different depths by the same number of foot pounds of impact provided in X number of seconds by the timed driver used to pound the hole maker prong into the ground.

In a preferred embodiment, to be described hereinafter, the hole maker prong may be marked along one of its sides by, for example, raised marker lines, to show the depth to which it is driven, thus the operator will on removing the prong from the earth, note the depth of the earth penetration and accordingly select from his stock pile, of varying length of concrete post bases, the proper length of post base for that particular hole.

The above feature has a considerable number of advantages over other post base systems because the tapered configuration extends the full depth of the base unit, not just the bottom part and thus, compacts the soil around it as it goes in the ground and of course, since the element pounded into the ground to make the holes is carrot shaped, the most compression is at the top of the base to thus make the base best able to resist lateral movement of a fence post for example. The present invention as to be detailed further herein, is also very useful as a foundation for buildings with an inverted U-shaped channel fitting over a number of the bases in a a line to form a wall foundation. It is important that every post have the same resistance level to further earth penetration so that the base support capability will be uniform for the full length of the wall foundation without soft spots or hard spots occurring in the line. It has been found that many cinder block or poured concrete walls crack because they are not setting on ground of the same compressability at all points.

In setting the wall foundation using the teachings of the present invention, the contractor will observe whether certain parts of the wall line are in much softer earth than the rest by noting the depth to which the different base units are required and thus, be able where required to put in extra bases in particularly soft areas. Further, forming foundations in the teachings of this invention, the foundation strength is immediate and can be immediately put to use as soon as the bases are in place, thus saving important and expensive time in building erection. Since the top channel member must be level and even employing a number of different lengths of base elements, plugs of varying size may be used to increase the height of certain of the base elements to the required level as shown by a level line and as to be detailed hereinafter.

The present invention further provides an integrated system of parts or elements which when properly employed, insure a sturdy, relatively long-lasting fence which may be economically erected in a minimum of time.

DETAILED DESCRIPTION OF THE DRAWING

Figure 1:
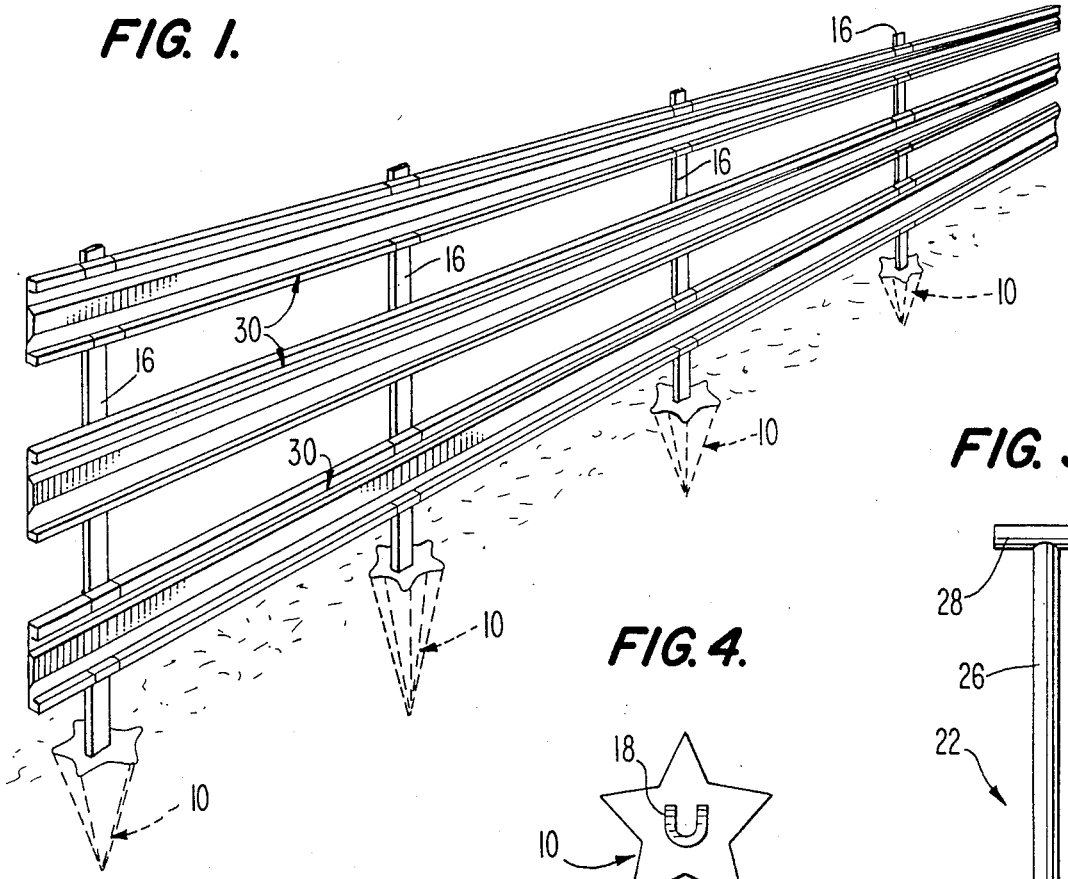
FIG. 1 is a perspective view of several sections of fence constructed of the components of the invention.
Figure 4:
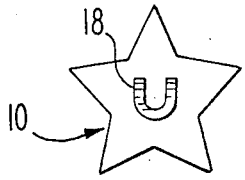
FIG. 4 is a top plan view of the post socket of the invention.

The system of the invention includes a preformed base member 10 which is roughly carrot-shaped in longitudinal dimensions, as more clearly illustrated in FIG. 4. The carrot-shape was selected, as it provides the base member 10 with greater surface area, thereby militating against frost heave or removal of the base once it has been imbeded to the proper depth in the soil. While the cross section of the base member 10 is illustrated as a five-pointed star, other regular or irregular configurations may be used to provide the larger surface area, which is desired.

The base member 10 is provided with a pointed end 12, and a larger head portion 14. Where the base 10 is to be used to support a fence post, such as 16, or other vertically extending element, the base 10 which is preferably cast from concrete is cast with an opening 18 of irregular or other required configuration such as the U-shaped opening illustrated in FIG. 4 or for height adjusting plugs. This permits anchoring a suitable adhesive that seals the bottom of the post into the top of the base member after the base member has been implanted.

Figure 5:
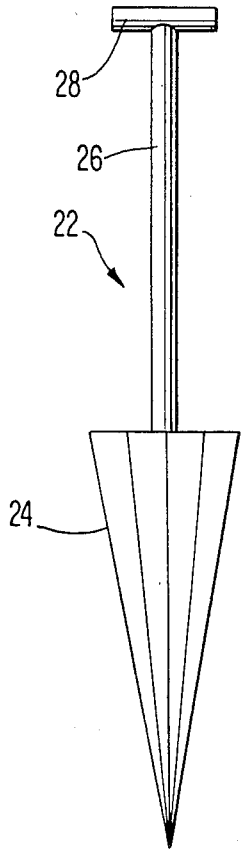
FIG. 5 is an elevational view of a socket forming tool.
Figure 2:
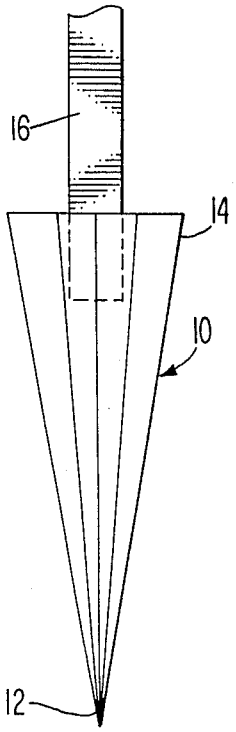
FIG. 2 is an elevational view of a prepared base element with a portion of a post mounted therein.
Figure 3:
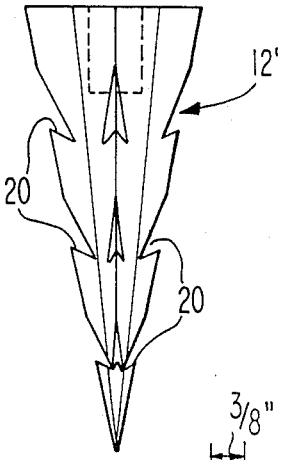
FIG. 3 illustrates a form of treatment for the lower end of the post supporting socket.

Referring particularly to FIG. 3, there is illustrated a base member 12' having serrations on each of the edges of the irregular configuration designated 20. These serrations because of the natural infill of earth material assist in anchoring the base member 10 in the soil and prevents removal or raising of the base element when, for example, frost heaves or a herd of cattle are fenced by the fencing system of the invention. The pre-cast base members 10 are not themselves, power driven into the soil. A prong or tong-like tool 22 is employed for making a hole in the earth configured substantially identical to the base to which is then sequentially inserted in the hole. FIG. 5 illustrates a suitable tool 22 for preforming the opening in the ground to receive base member 10. The tool 22 comprises a base member 24, a post 26, and a top plate 28. The configuration of the base 24 would be substantially identical to the base member 10 of the post support element. Preferably, the entire tool 22 is cast from a ferrous metal to withstand the impact insertion into ground which may contain stones, etc. The tool 22 may be driven into the ground by man power, however, preferably the tool 22 is driven by compressed air, a small one man gasoline driven impact hammer, or hydraulically by a truck carried machine which is pre-setable to drive the tool to a predetermined driving force level, thus, all of the inserted base members 10 have equal weight bearing anchorage in the soil.

Figure 14:
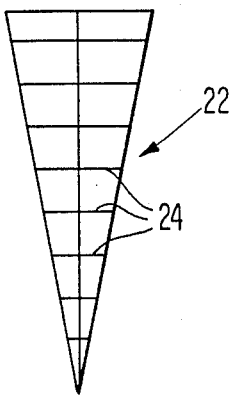
FIG. 14 illustrates a form of base member of the hole motor prong having indicia or line markings thereon to assist workmen in selecting the proper size base element after the hole maker prong has been driven into the ground.

It will also be recognized by those skilled in the art that when fencing an extended area, a number of ground conditions will be encountered and merely employing a uniform inserting force, would not in all cases be sufficient to give uniform heighth to the post bases above ground, thus it is contemplated that a variety of tools 22 varying in length, diameter, and marking such as 24 in FIG. 14, may be necessary also with a varying number of different sized and proportioned base members 10.

Once the base members 10 are inserted in the preformed hole in the earth, the heighth adjusting posts or plugs for the foundation use 16—16' are inserted in the cast opening 18 and rigidly secured therein by suitable adhesives such as epoxy cement. Once the posts or plugs 16—16' have been inserted to create a level foundation base and the adhesive hardens, the rails designated 30, are attached thereto.

Figure 6:
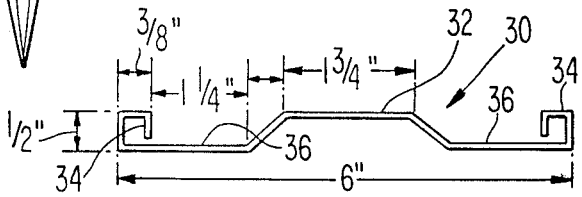
FIG. 6 is an end view of a novel rail for the fence.
Figure 7:
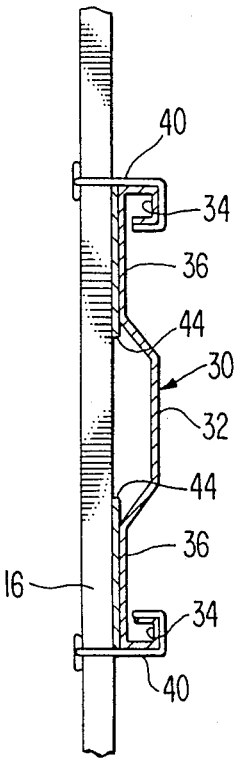
FIG. 7 is a vertical, partially sectional, view of a post rail and clip of the invention.

Referring to FIGS. 6 and 7, in particular, the rails 30 are roll formed for economy of manufacture, which may be done on site from coil, and to provide a central flat face 32 and a pair of recurved end portions 34 of box-like configuration so made to give lateral rigidity. In a preferred embodiment, the entire width of a rail 30 is for example, six inches and the box elements 34 have heighths in the order of ¾ inch and widths in the order of ¾ inch. The flat face 32 has a width dimension of 1 ¾ inch, whereas the width of the other flat faces 36 have widths in the nature of about 1 ¼ inch. The roll formed rails 30 are uniquely attached to each post by a pair of metal clips generally designated 40. Each clip goes about the rear face of a post 16 and clips into the recurved box portions 34 at its edge and springs into locked relationship at the ends of the wire clip. Once the clips are in place, the clips are twisted or bent as at 42, FIG. 8 of the drawing, thus securing each rail to its post in a tensioned clip manner. In a preferred assembly, between the flat faces 36 and the post 16, is a mastic material 44 which permits some give in the assembly to account for thermal expansion and contraction. The mastic 44 may be replaced by rubber pads as would be appreciated by those skilled in the art.

The man hours involved in erecting a fence or a building following the teachings of the present invention, is substantially and materially less than in normal erection, where posts are inserted in excavated holes and the posts are cemented in place. Before foundation channels, fence posts, rails or other barrier materials can be attached to such posts, the concrete would have to set, whereas in an assembly as described herein, the base member units have already been cast and cured and hardened prior to their insertion into the preformed openings and they may therefore be put to use immediately.

Figure 8:
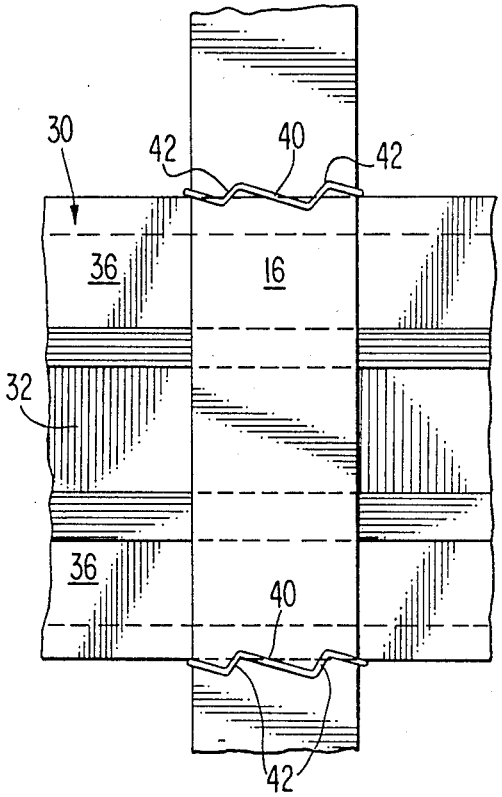
FIG. 8 is a front elevational view of the structure shown in FIG. 7.
Figure 9:
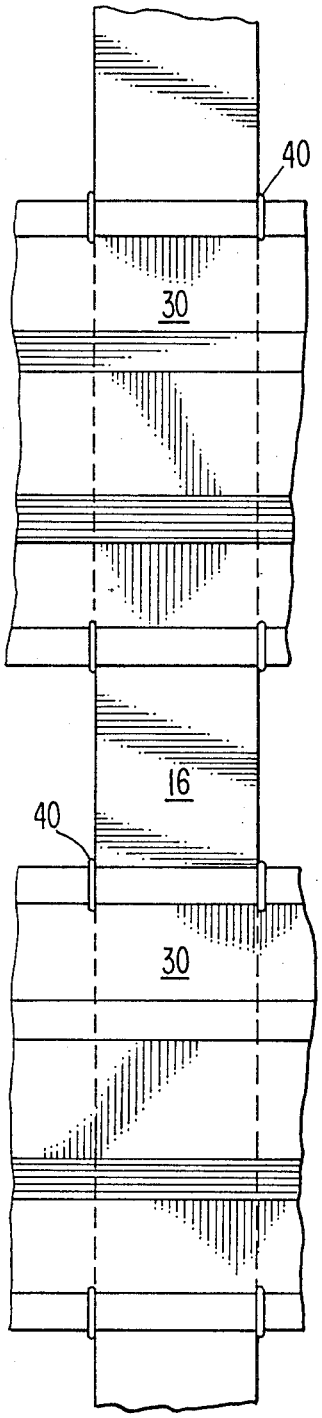
FIG. 9 is a view like FIG. 8, but of the opposite side.
Figure 10:
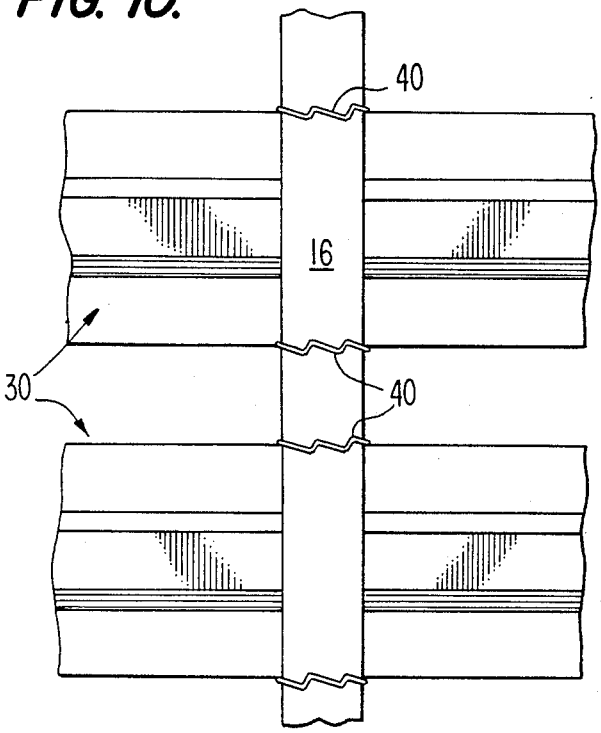
FIG. 10 is a view of the opposite of the structure illustrated in FIG. 9.
Figure 11:
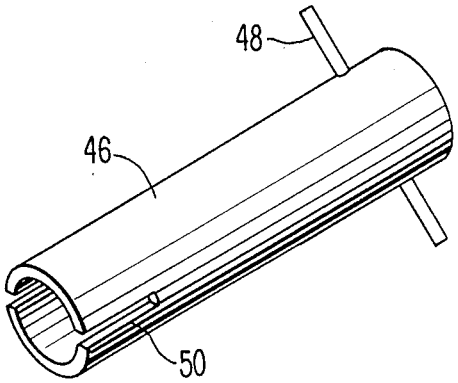
FIG. 11 is a perspective view of one form of tool for crimping the rail attaching clips.

As herein before described, the clips 40 after connecting to a roll formed rail 30 and a post 16 are crimped or twisted to tighten the contact between the rail and the post and to provide the assembly with a firm spring tension action. In FIG. 11, a suitable twisting or crimping tool is illustrated, comprising a cylindrical shell 46 provided at its upper end with a transverse handle 48 and at its lower end with a slot in the cylindrical wall 50. The slot has a width sufficient to receive therein the clip 40 and by twisting via the handle, the tensioning crimp illustrated at 42, FIG. 8, is formed in the clip.

Figure 12:
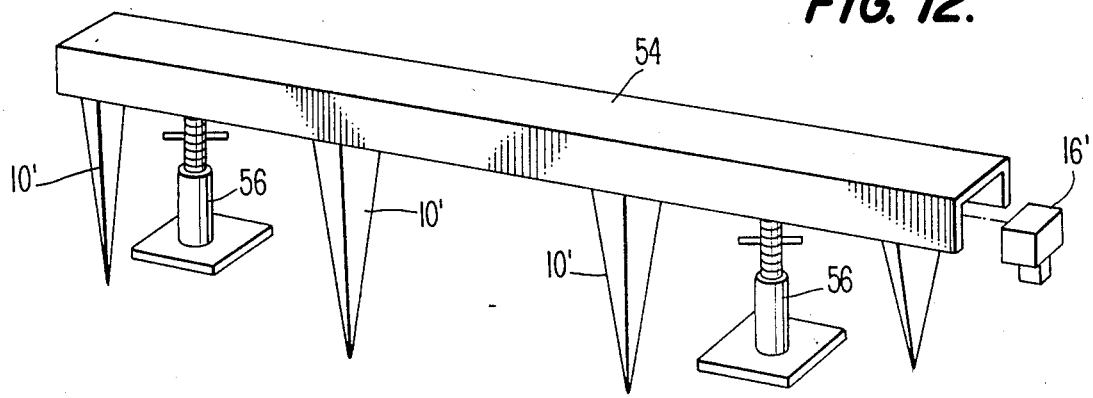
FIG. 12 illustrates the support of a beam or header on a plurality of the preformed ground engaging support members.

As herein before discussed, the ground implanted base members 10 may support beams or headers in a foundation system for a building structure. Referring now to FIG. 12, the ground implanted base members are designated 10' and the number or linear density of such units employed is dependent upon the nature of the building structure, such as a one story or two story dwelling. The base elements 10' are inserted in preformed openings as previously discussed. In FIG. 12, the base elements 10' are shown at different heights as they are inserted within a hole produced by the tool 22 forced into the ground under uniform force or pressure.

To level the channel 54, and provide equal base support for the channel height, adjusting blocks 16' of varying size are used to correct for varying base height under channel 54.

When the building component is delivered and is to be placed on channel 54, a series of hydraulic jacks may be used, connected by fluid lines, for equal pressure, to off load and lower the component structure uniformly to rest on the foundation channel 54.

Following this system, a foundation for a building structure can be formed in a minimum of time by relatively unskilled workers in the field and without heavy foundation digging equipment, cranes, cement mix, trucks, etc.

Where desired, the opening 18 in each of the bases may receive a bolt and/or be cemented therein to positively anchor the base to its plurality of posts.

Figure 13:
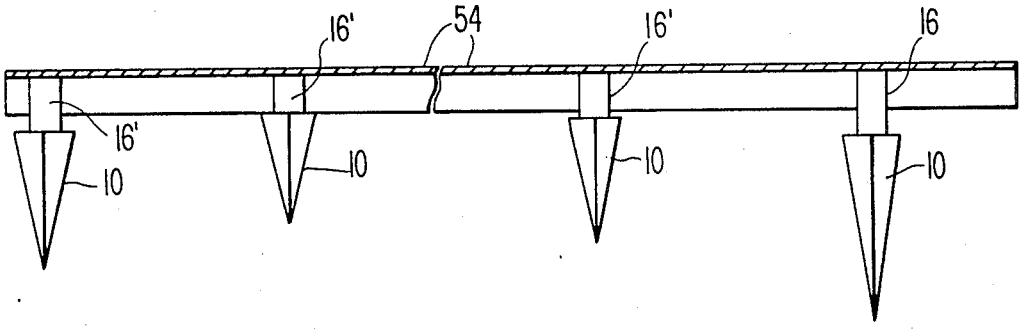
FIG. 13 illustrates plugs for height adjustment which fit into the cast base element particularly useful when employing the base elements to support a U-shaped beam.

As herein before mentioned, leveling of the base contact plugs 16' cast in various lengths and inserted in cast holes in each of the base members 10 is sequentially illustrated in FIGS. 12 and 13. It is recognized that employing the plugs 16' would not exactly level a beam 54 without the use of further spacer chips cemented in place and to beam 54 to fine tune the level fit, but the plugs and chips do reduce, to a major degree the additional bearing force variations on top of the plugs required for a level foundation.

From the foregoing description of preferred embodiments of the present invention, it will be recognized by those skilled in the art, that various modifications may be made in the components thereof without departing from the scope of the appended claims.

I claim:

1. A ground inbeded support system, comprising a carrot shaped, metal hole making and measuring tool, coming to a point at the bottom, with a depth scale on the side of the tool to measure the soil density by the depth to which the tool is driven into various soils of different density during a preset period of uniform driving impact done to make the hole, and to indicate the length of base member to be put in place in the hole made by the tool without impact to fit the depth of the hole made by the tool, and to provide uniform weight bearing capacity of each base member, so set in ratio to the time period of driving impact used, a power driven impact driver unit, capable of delivering various preset periods of uniform driving impact to the top of the holemaking and measuring tool, base members of the same configuration as the tool with the top structure of the members containing sockets suitable for the insertion of fence posts, or suitable means for the attachment of building support members.

2. The ground imbeded support system as defined in claim 1 including a plurality of roll formed rails for securement to each post and spring wire clips, tensioned after application, for attaching each roll formed rail to its post by means of a wire crimping or twisting action to shorten and tension the wire of the clip by this deformation.

* * * * *